US006257248B1

(12) United States Patent
Yeh

(10) Patent No.: US 6,257,248 B1
(45) Date of Patent: Jul. 10, 2001

(54) BOTH HAND HAIR CUTTING METHOD

(76) Inventor: Wen-Ya Yeh, No. 18 Chuney - Hsueh Road, Tainan City (TW)

( * ) Notice: Subject to any disclaimer, the term of this patent is extended or adjusted under 35 U.S.C. 154(b) by 0 days.

(21) Appl. No.: 09/459,227

(22) Filed: Dec. 10, 1999

(51) Int. Cl.[7] ..... A45D 24/34; A45D 24/00
(52) U.S. Cl. ..... 132/213; 132/213.1; 132/200
(58) Field of Search ..... 132/213, 213.1, 132/214, 212, 200; 30/254, 255, 256, 30

(56) References Cited

U.S. PATENT DOCUMENTS 1,662,373 * 3/1928 Widdows ..... 132/213.2
3,934,340 * 1/1976 Jones et al. ..... 30/200
4,368,745 * 1/1983 McGuffey ..... 132/213.1
5,012,830 * 5/1991 Vaccaro et al. ..... 132/213.1
5,067,502 * 11/1991 D'Orsi et al. ..... 132/213.1
5,349,971 * 9/1994 Player ..... 132/213.1
5,813,417 * 9/1998 Rudolph ..... 132/200
5,991,918 * 11/1999 Choate ..... 2/21
6,079,107 * 6/2000 Horvath ..... 30/233.5
6,135,123 * 10/2000 Grassi et al. ..... 132/213

* cited by examiner

*Primary Examiner*—John J. Wilson
*Assistant Examiner*—Robyn Kieu Doan
(74) *Attorney, Agent, or Firm*—Alan D. Kamrath; Rider, Bennett, Egan & Arundel, LLP

(57) ABSTRACT

A both hand hair cutting method is for hairdressers to hold proper tools, such as scissors, razors, electric cutters, plural scissors, in a right hand and a left hand to perform cutting at the same time or not at the same time, depending on personal hair quality, hair quantity, length and needed styles. The lower levels of the right side and the left side of hair can be cut to have the same directions, and cutting the angle of hair, combing hair, and trimming the lower ends of hair can be easily performed by a hairdresser according to this method. The hairdresser is not disturbed by the head shape, the ears, the shoulders, and the hair length of a customer. The hair can be cut with fastness, enabling the finished hair style to look soft, natural and beautiful.

20 Claims, 13 Drawing Sheets

FIG.3
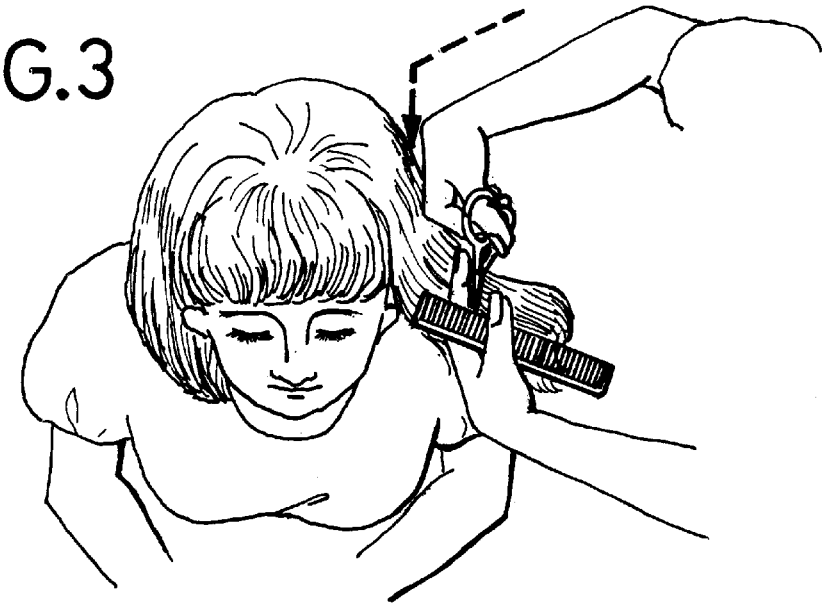
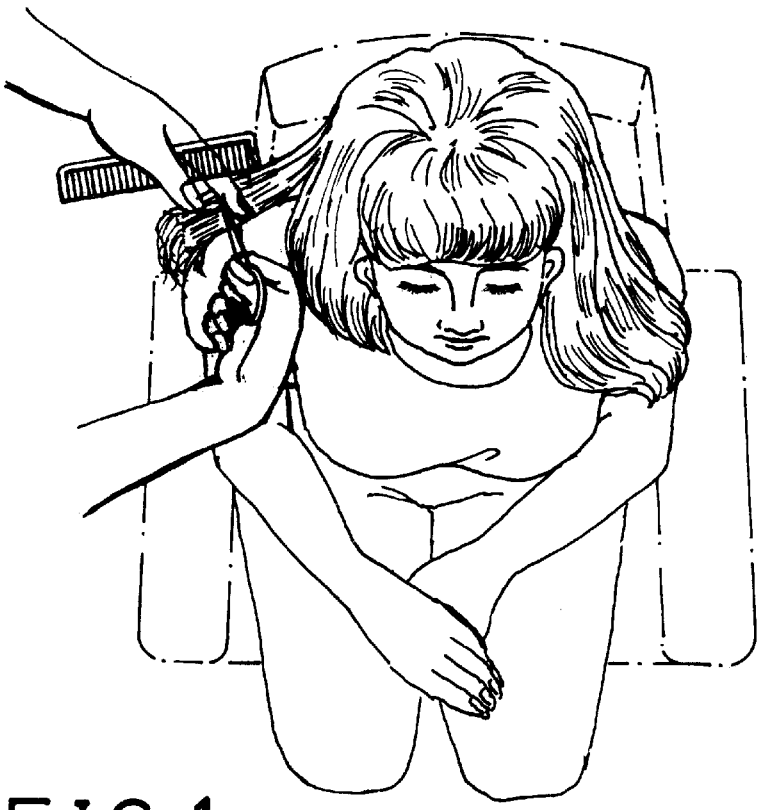
FIG.1

FIG.5
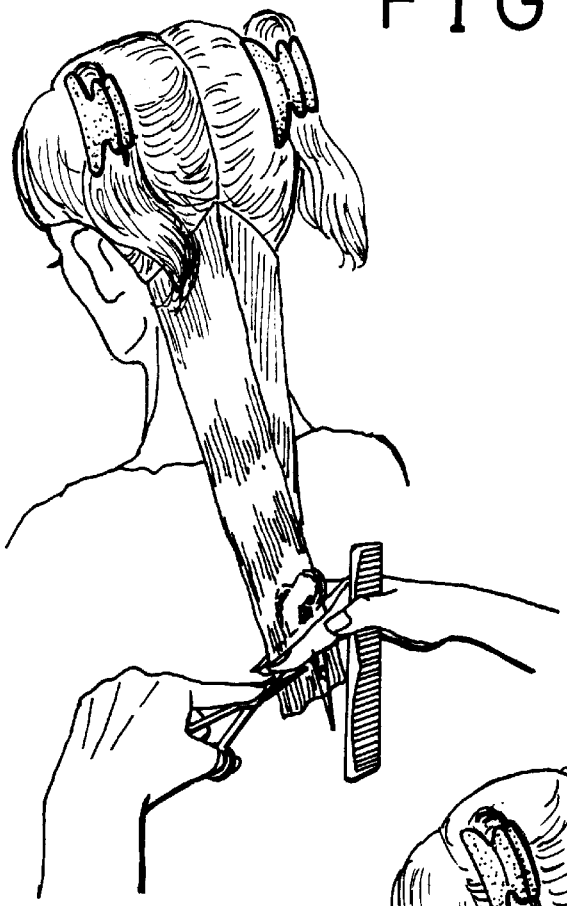
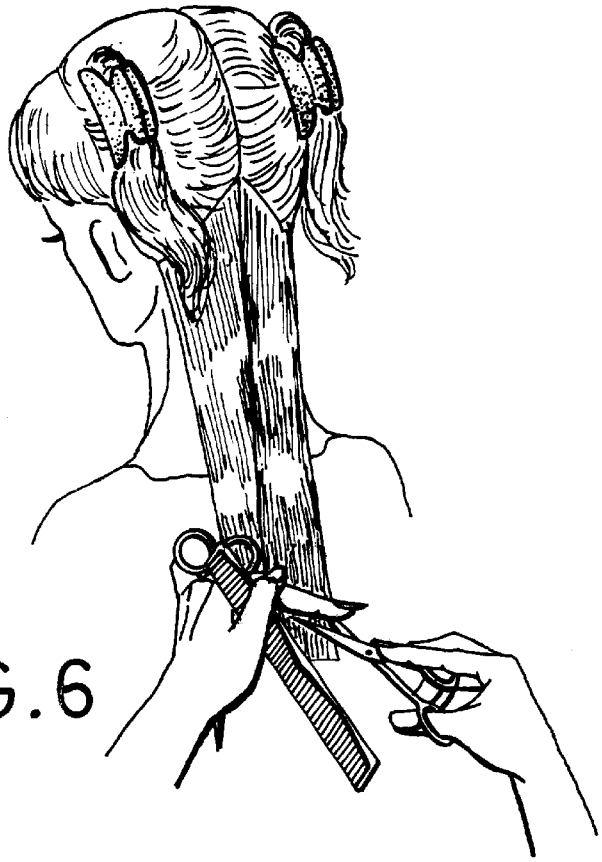
FIG.6

FIG.17
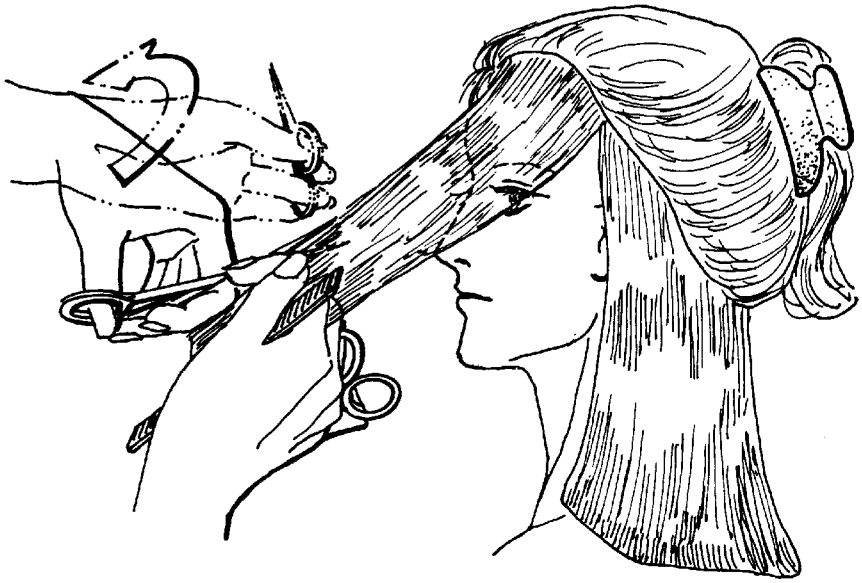
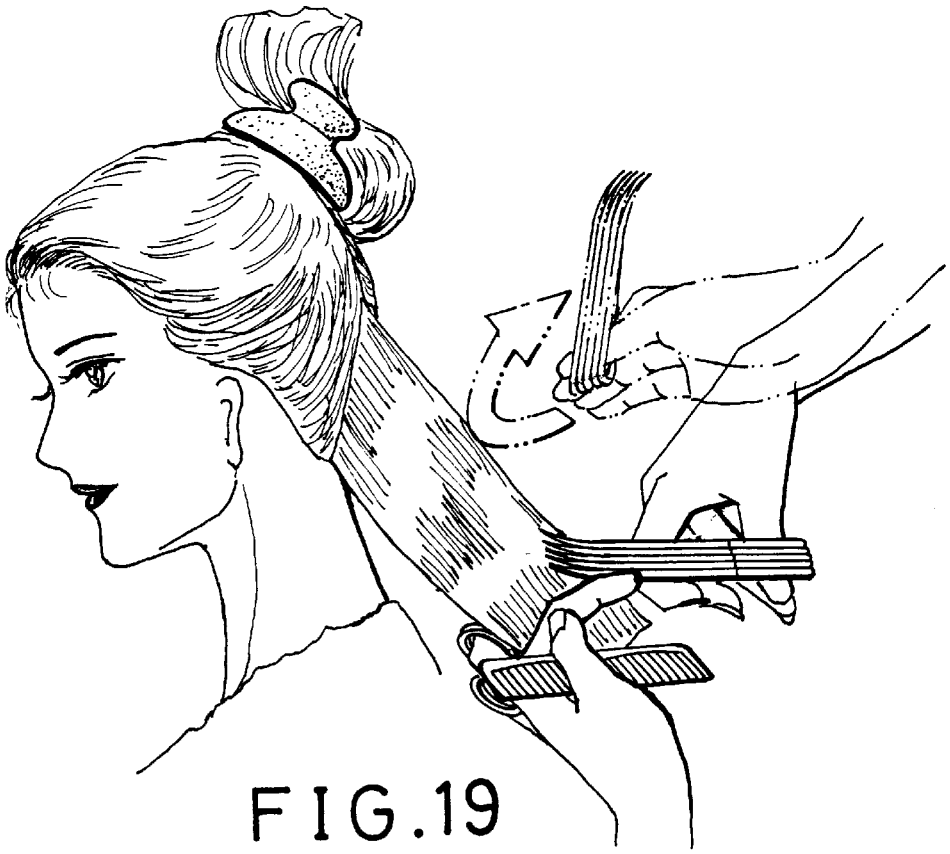
FIG.19

FIG.18
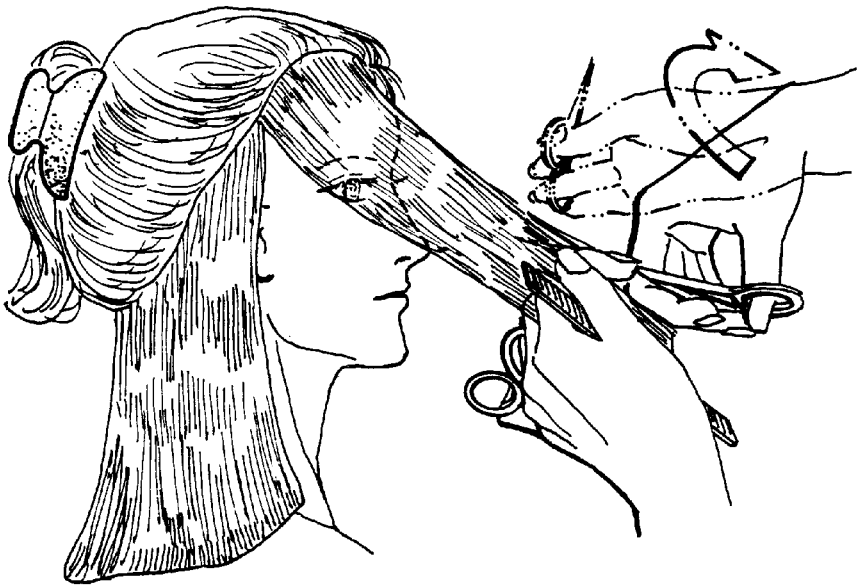
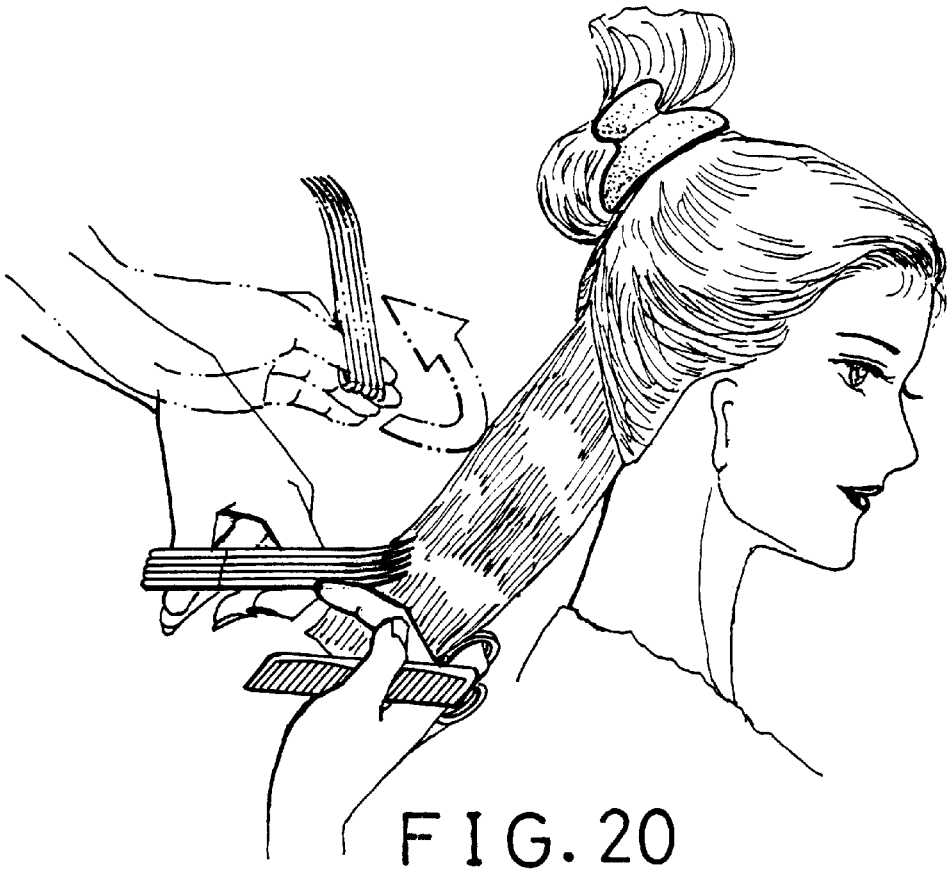
FIG.20

FIG. 22
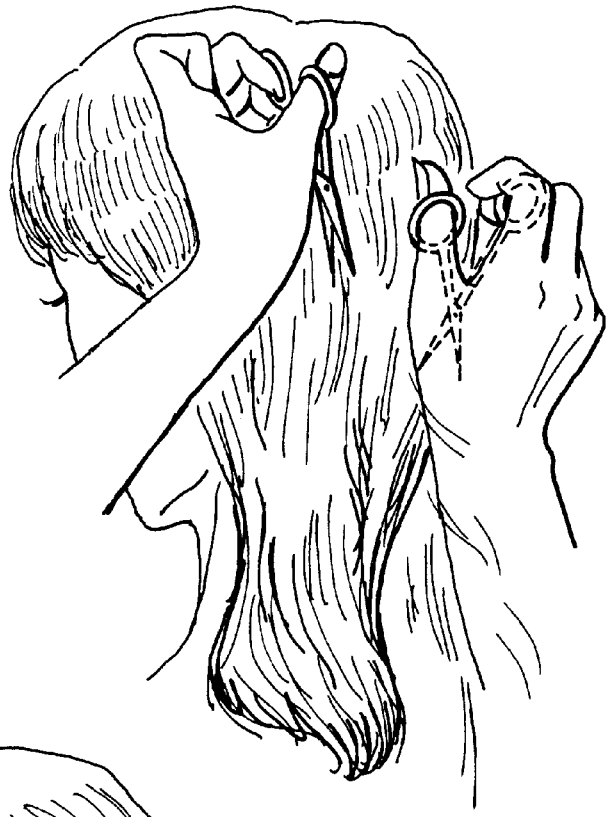
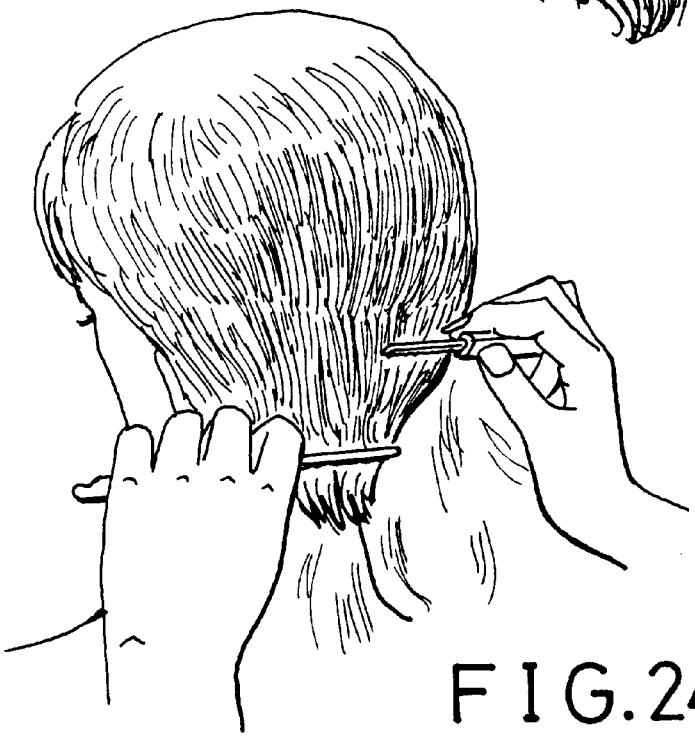
FIG. 24

BOTH HAND HAIR CUTTING METHOD

BACKGROUND OF THE INVENTON

This invention relates to a both hand hair cutting method, particularly to a method of using a right hand for holding a cutting tool (including scissors, razors, electric hair cutters, plural pairs of scissors, etc.), and of using a left hand for holding a cutting tool for handling at the same time or not at the same time, in order to improve completely both sides of the hair to have the same lower level facing in the same direction. In addition, this method permits hairdressers to easily cut the angle of hair, to comb hair, and to trim two sides in balanced condition, while not being disturbed by the head shape, the ears, the shoulders and the length of the hair of a customer. This method enables hairdressers to cut and adjust the thickness to be cut with quickness, with the finished hair style looking natural, soft and beautiful.

At present, hairdressers generally hold a cutting tool in one hand only, in either the right or the left hand, while cutting the hair of a customer, combing and cutting the hair at the same time for forming a predetermined hair style. This kind of a single hand cutting only by a right hand or a left hand may result only in a smooth right or left side of the hair. Also as shown in FIGS. 1 and 2, when a hairdresser begins to cut the hair of a customer, the hairdresser has to stand behind the customer to cut the hair on the side not accustomed to cut with a tool, as shown in FIG. 3. The finished hair style may seem smooth at first but, later after a night or after washing, the hair may look smooth on one side with the other side bent or curled forward, as shown in FIG. 4. Hairdressers, have to work every day for a long period of time with their hands always raised at a certain height for holding a comb and scissors, so they may suffer from various professional diseases such as edema, stomach illness, a frozen shoulder, a stiff shoulder, a bent backbone, etc.

SUMMARY OF THE INVENTION

One objective of the invention is to offer a hair cutting method for hairdressers to apply in cutting or trimming a hair style for customers, to overcome the problem of differences of the lower levels of two sides after finished cutting, and to overcome the problem of easy operation on one side and of difficult operation on the other side of the hair according to personal working habit, with both hands holding a cutting tool but not cutting at the same time.

Another objective of the invention is to offer a hair cutting method with a right hand and a left hand, using scissors, razors, or electric scissors synchronously at the same time, especially for cutting a large quantity of hairs. Then lower levels of the right and left sides of hair may be cut or trimmed in a balanced condition and with fastness. Also, the finished hair style may have the same lower level of the two sides.

BRIEF DESCRIPTION OF DRAWINGS

This invention will be better understood by referring to the accompanying drawings, wherein:

FIG. 1 is an upper view of cutting hair with one hand in a conventional cutting method;

FIG. 3 is an upper view of cutting hair with one hand in a conventional cutting method with a hairdresser standing behind a customer for easily and smoothly cutting hair;

FIG. 5 is a perspective view of cutting hair with a left hand and holding hair with a right hand in the method in the present invention while cutting is not performed at the same time with both hands;

FIG. 6 is another perspective view of cutting hair with a right hand and holding hair with a left hand in the method in the present invention while cutting is not performed at the same time with both hands;

FIG. 17 is a side view of cutting hair with a left hand with a fast movement and with a right hand holding hair in the method in the present invention while cutting is not performed at the same time with both hands;

FIG. 18 is another side view of cutting hair with a right hand with a fast movement and with a left hand holding hair in the method in the present invention while cutting is not performed at the same time with both hands;

FIG. 19 is a side view of cutting hair with plural scissors with a right hand and holding hair with a left hand in the method in the present invention while cutting is not performed at the same time with both hands;

FIG. 20 is another side view of cutting hair with plural scissors with a left hand and sliding hair with a right hand in the method in the present invention while cutting is not performed at the same time with both hands;

FIG. 22 is a front view of cutting hair with both hands at the same time in the method in the present invention;

FIG. 24 is a front view of cutting hair with razors in both hands at the same time in the method in the present invention;

DETAILED DESCRIPTION OF THE PREFERRED EMBODIMENT

A preferred embodiment of a both hand hair cutting method in the present invention, as shown in FIGS. 5–22, includes two systems of holding various tools and cutting modes respectively in a right hand and a left hand.

1. The first system.

(1) The first system is holding tools in both hands but performing cutting not at the same time. As shown in FIGS. 5 and 6, this is a common cutting way, cutting hair in a lateral direction. During cutting hair, scissors are expanded to let the front ends of two blades open wider than the lower portions near the shaft, so hair will not be completely cut off at the lower level until the front ends of the blades are closed. So cutting the left side of the hair with a left hand and cutting hair of the right side with a right hand can trim the lower levels of the left and the right sides to be the same, avoiding the disadvantage of different lower levels of the right and the left sides of the hair as in the case of cutting with only one hand in the conventional method.

Figure 2:
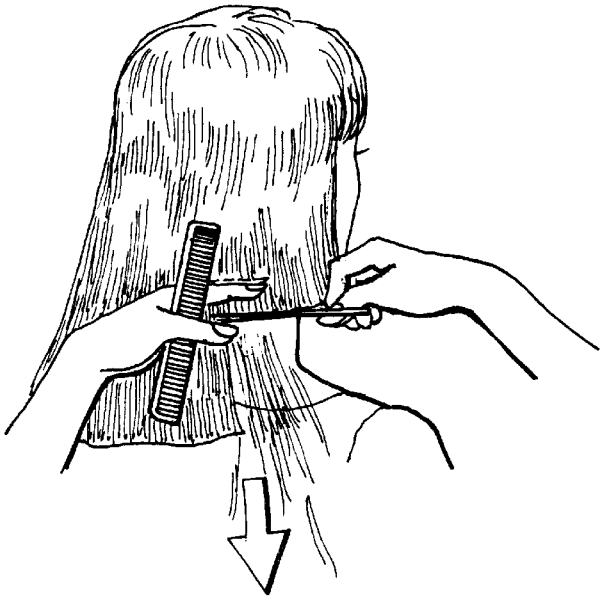
FIG. 2 is a side view of cutting hair with one hand in a conventional cutting method.
Figure 4:
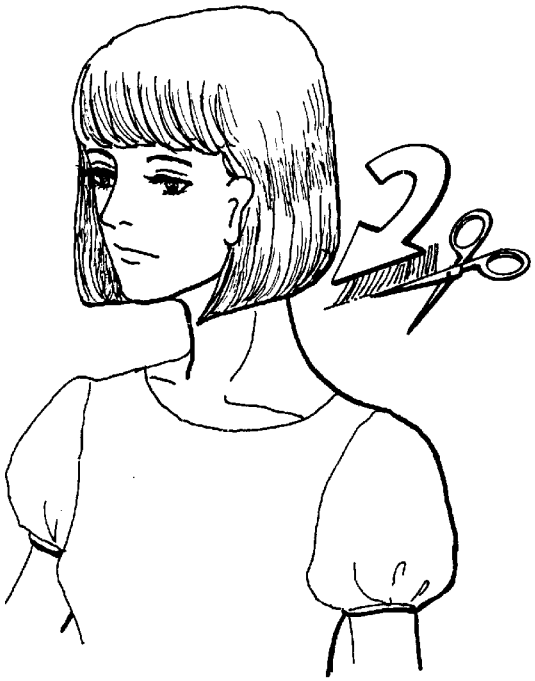
FIG. 4 is a front view of a finished hair cut having one side with a lower level smooth and the other side with a lower level not being smooth and being different from the one side in a conventional cutting method.
Figure 7:
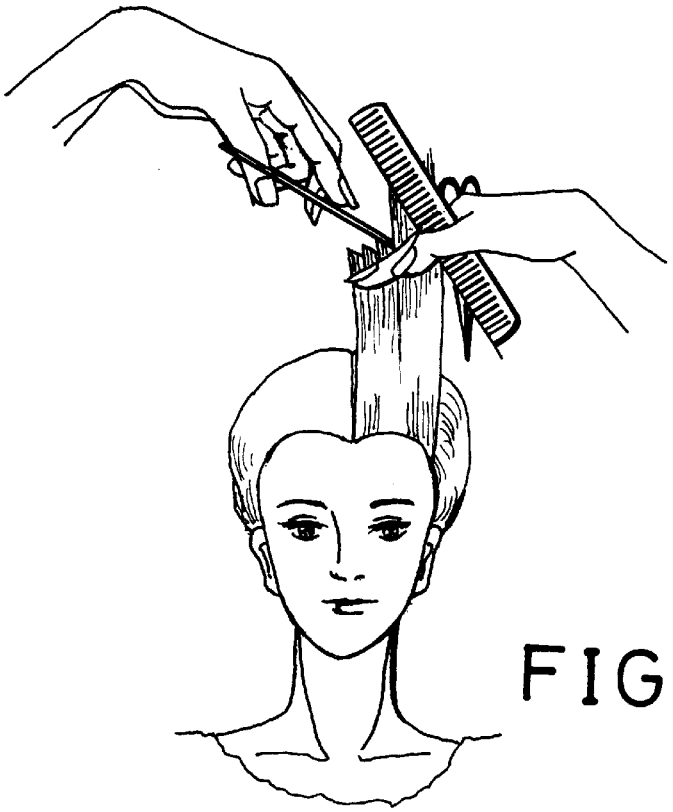
FIG. 7 is a front view of cutting hair in a zigzag way with a left hand and holding hair with a right hand in the method in the present invention while cutting is not performed at the same time with both hands.
Figure 8:
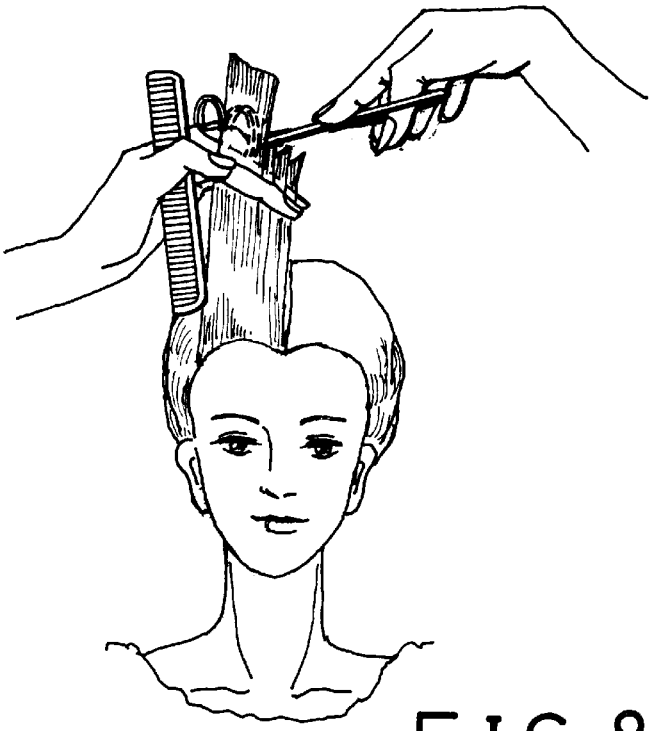
FIG. 8 is another front view of cutting hair in a zigzag way with a right hand and holding hair with a left hand in the method in the present invention, while cutting is not performed at the same time with both hands.
Figure 10:
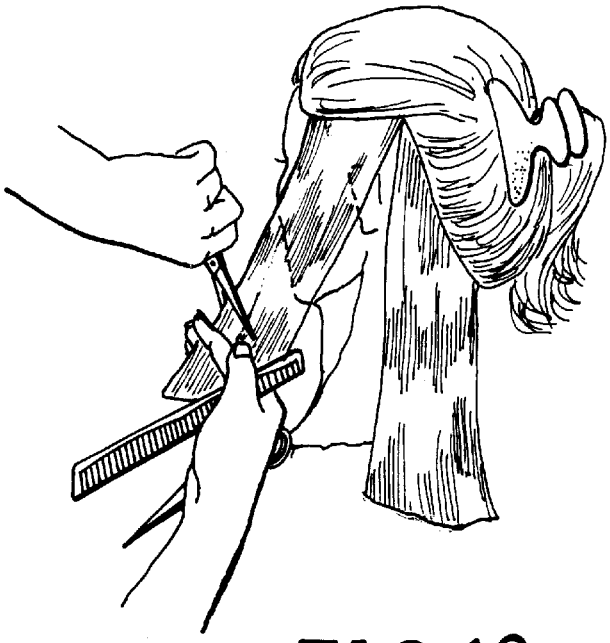
FIG. 10 is another side view of cutting hair slidingly with a left hand and holding hair with a left hand in the method in the present invention while cutting is not performed at the same time with both hands.
Figure 9:
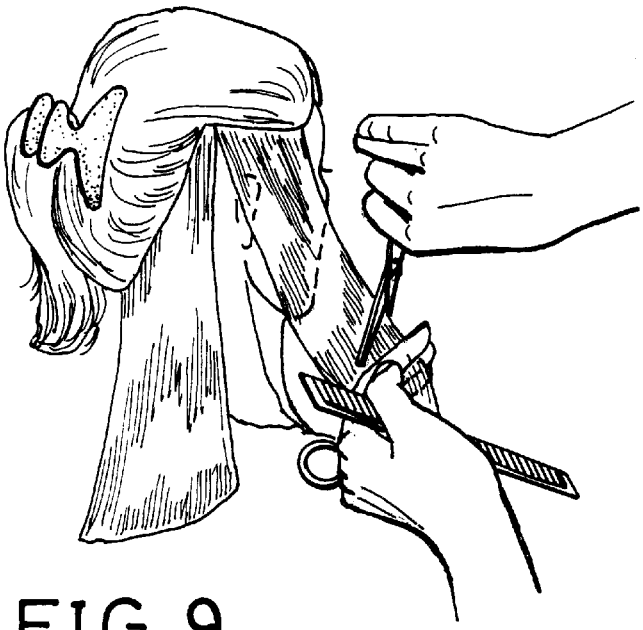
FIG. 9 is a side view of cutting hair slidingly with a right hand and holding hair with a left hand in the method in the present invention, while cutting is not performed at the same time with both hands.
Figure 11:
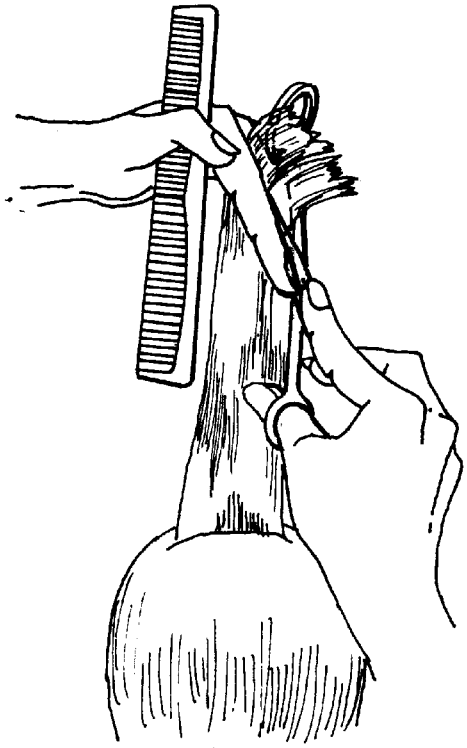
FIG. 11 is a front view of cutting hair temporarily with a right hand and holding hair with a left hand in the method in the present invention while cutting is not performed at the same time with both hands.
Figure 12:
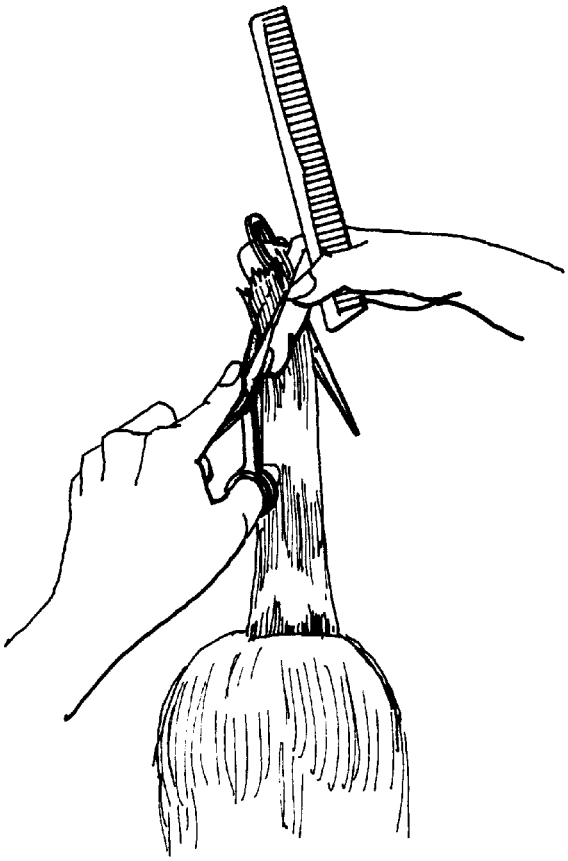
FIG. 12 is another front view of cutting hair temporarily with a left hand and holding hair with left hand in the method in the present invention while cutting is not performed at the same time with both hands.
Figure 13:
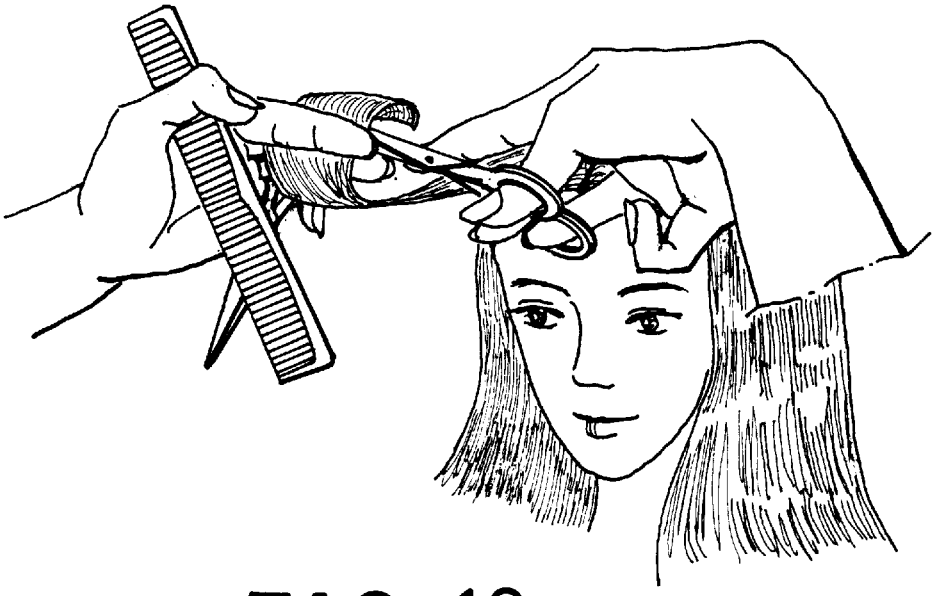
FIG. 13 is a front view of cutting hair with a right hand and bent with a left hand in the method in the present invention while cutting is not performed at the same time with both hands.
Figure 14:
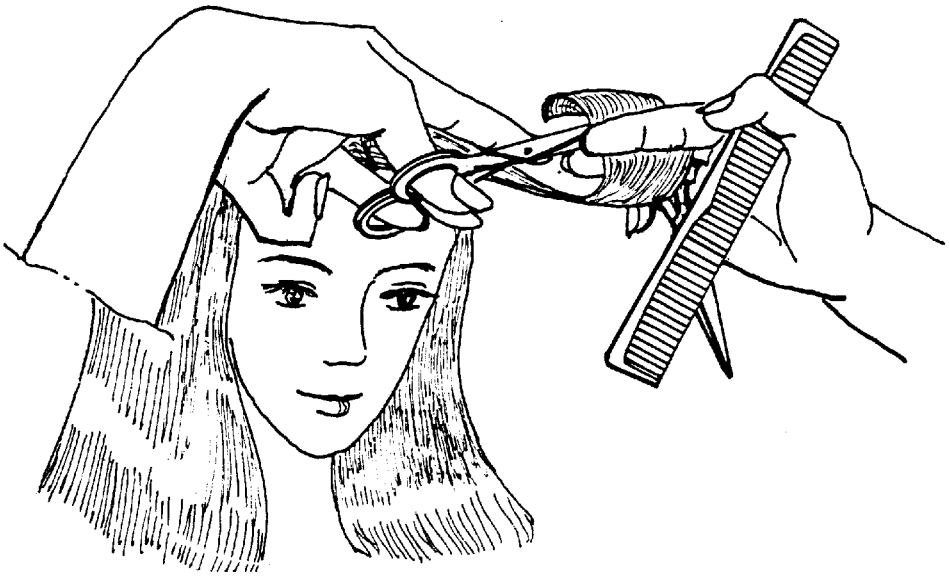
FIG. 14 is another front view of cutting hair with a left hand and bent with a right hand with the method in the present invention while cutting is not performed at the same time with both hands.
Figure 15:
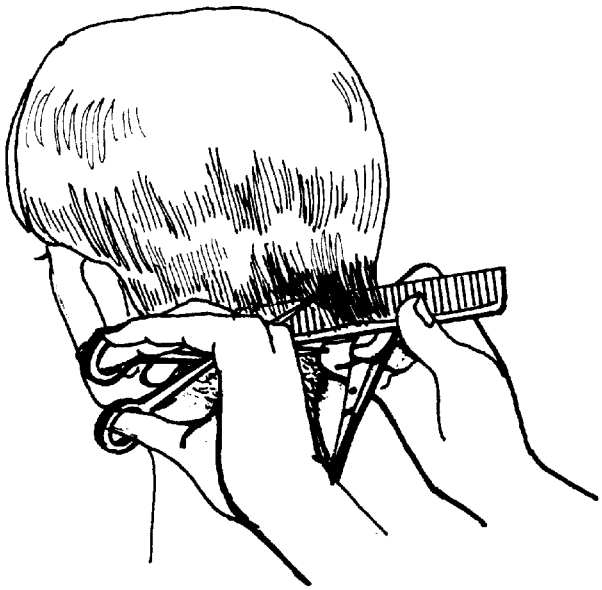
FIG. 15 is a front view of cutting hair with a left hand and pushing hair with a right hand at the same time with the method in the present invention while cutting is not performed at the same time with both hands.
Figure 16:
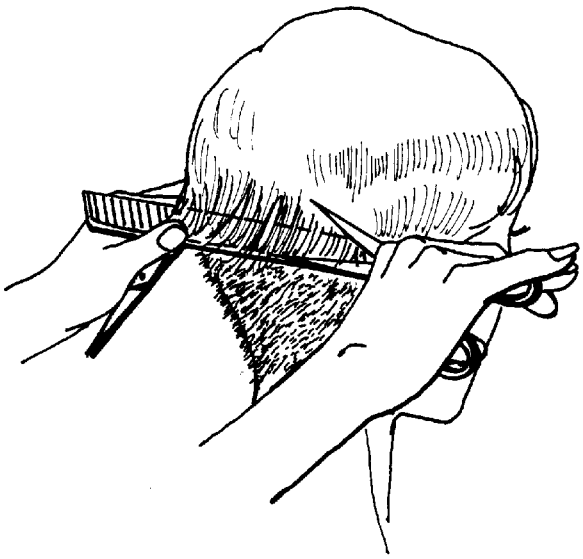
FIG. 16 is a front view of cutting hair with a right hand and scooping with a right hand in the method in the present invention while cutting is not performed at the same time with both hands.
Figure 21:
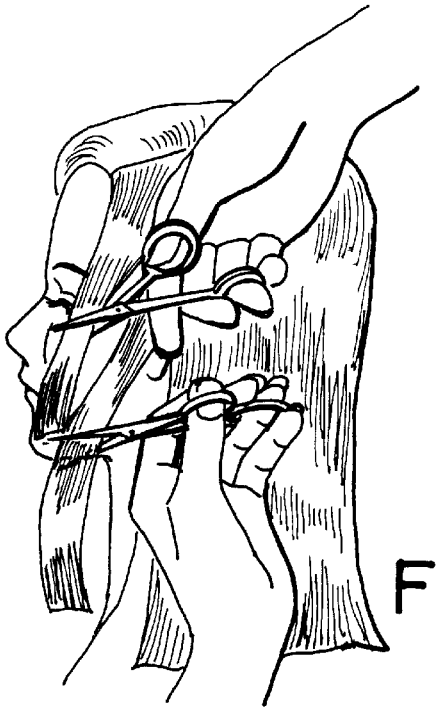
FIG. 21 is a side view of cutting hair with both hands at the same time in the method in the present invention.
Figure 23:
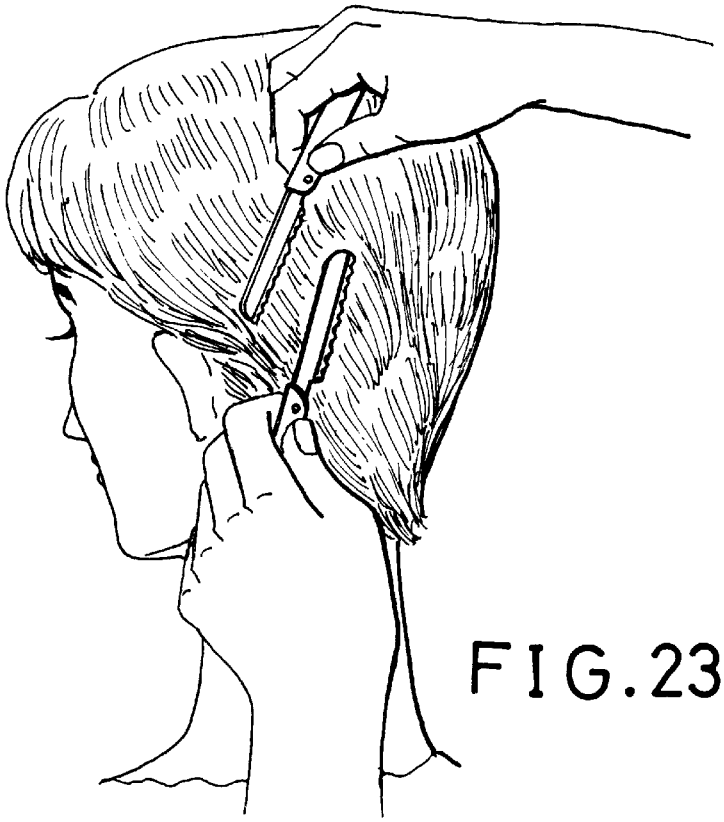
FIG. 23 is a front view of cutting hair with razors in both hands at the same time in the method in the present invention.
Figure 25:
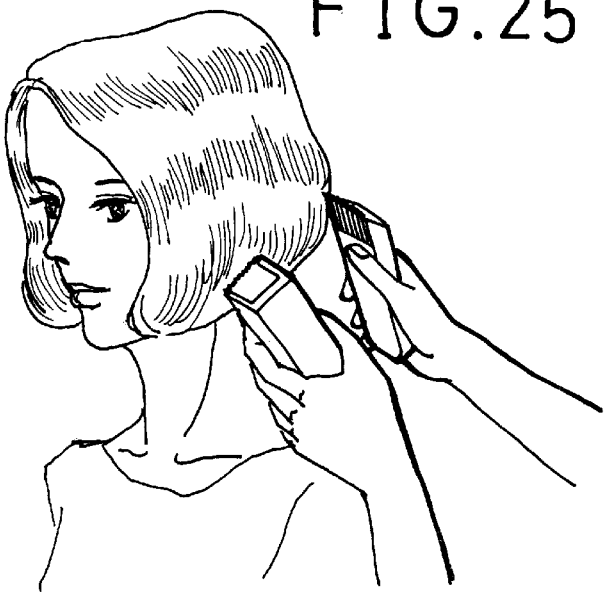
FIG. 25 is a side view of cutting hair with electric cutters in both hands at the same time in the method in the present invention; and, FIG. 26 is a front view of cutting hair with a common scissors combined with a teeth or zigzag shaped scissors in the method in the present invention while cutting is not performed at the same time with both hands.

(2) Other cutting methods, such as teeth (or zigzag) shape cutting shown in FIGS. 7 and 8, cutting with a slide movement shown in FIGS. 9 and 10, cutting temporarily shown in FIGS. 11, 12, cutting with hair bent or curled up shown in FIGS. 13 and 14, cutting with a push movement shown in FIG. 15 and cutting with a scoop movement shown in FIG. 16, are respectively used to make various hair styles. As different hair styles need different cutting angles of hair, different combing directions, and different lower levels of hair, the right side of hair should be treated by a right hand and the should be treated by a left hand for obtaining a balanced condition of the right and the left sides of hair. Hairdressers may not feel disturbed by the shape of the head, the ears, the shoulders, etc. of a customer. Thus, difficulty in cutting both sides of hair with only one hand can be overcome.

(3) Next, cutting with both hands with fast movement shown in FIGS. 17 and 18 is used to trim hair into elegant condition and with excellent effect. Especially, this cutting method applies to cut hair at different height (or length), and to form the lower end of hair with speedy movement, letting the hair style look soft, pretty, streamlined, and stabilized not to deform. Thus, difficulty in obtaining symmetry in the style, the angle, and the lower level of hair by only one hand cutting method can be overcome by the method in the present invention.

(4) Cutting with one hand holding plural scissors shown in FIGS. 19 and 20 is used for making 3D hair styles, forming expected notches of many layers of different height of hair so that when the hair is loosened and expanded, the hair may look naturally beautiful and soft. This method can be applied to both long and short hair to be trimmed in many layers, adjusting the quantity of hair to be cut, and can be applied with fastness, overcoming drawbacks of the conventional one hand cutting method.

Figure 26:
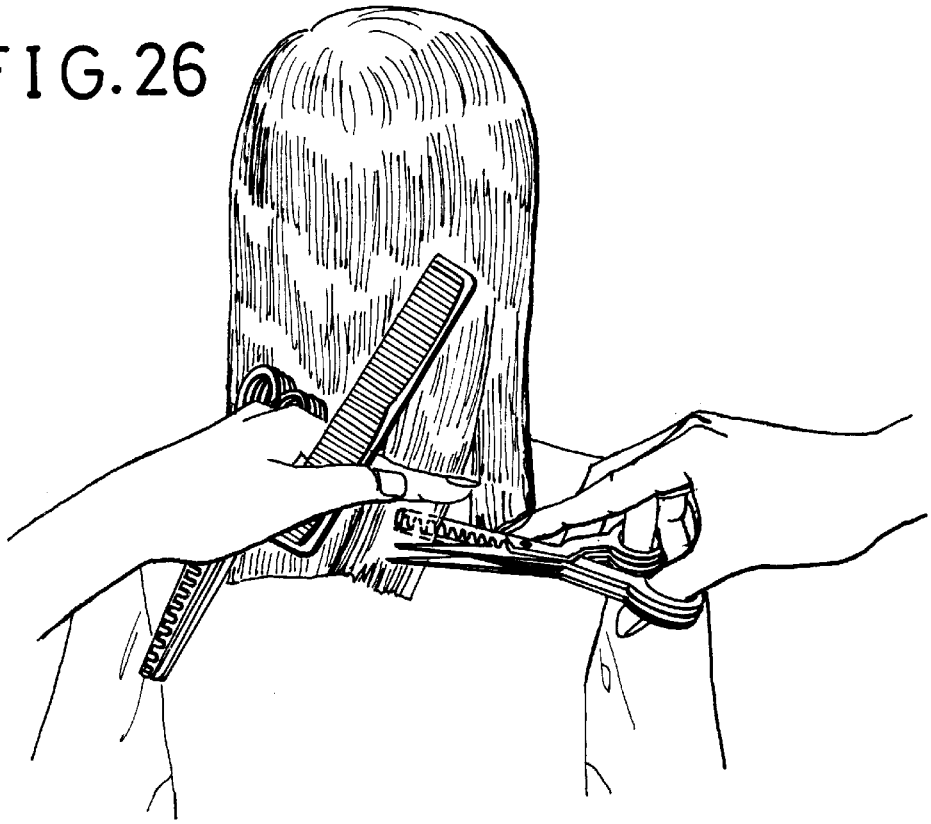

(5) Adjusting the quantity of hair to be cut and cutting hair shown in FIG. 26 is performed by using common scissors combined with a teeth (or zigzag) shaped scissors synchronously so as to cut the hair length needed and at the same time thinning and adjusting the volume of hair cut.

As described above, hairdressers can hold different tools in the right and the left hand in cutting and trimming hair of customers, forming the lower levels of the right and the left side of hair facing in the same direction, and speeding operation faster than the conventional one hand method.

2. The second system.

The second system is cutting hair with both hands at the same time. Synchronous cutting operation with both hands holding scissors, razors, or electric cutters shown in FIGS. 21–25 can be applied to cut a large quantity of hair or to adjust the quantity of hair to be cut. This synchronous cutting operation can secure the lower levels of the right side and the left side of hair in the same direction, can provide symmetry of both sides of hair, and enables the finished hair style to look beautiful, natural and soft.

While the preferred embodiment of the invention has been described above, it will be recognized and understood that various modifications may be made therein and the appended claims are intended to cover all such spirit and scope of the invention.

What is claimed is:

1. A both hand hair cutting method comprising: holding a first hair-cutting tool in a right hand of a hairdresser; simultaneously holding a second hair-cutting tool in a left hand of the hairdresser while the first hair-cutting tool is held in the right hand; and finish cutting a customer's hair with the first and second hair-cutting tools simultaneously or non-simultaneously using both the right and left hands holding the hair-cutting tools in the right and left hands simultaneously.

2. The both hand hair cutting method as claimed in claim 1, wherein at least one of the first and second hair-cutting tools is a pair of scissors.

3. The both hand hair cutting method as claimed in claim 1, wherein at least one of the first and second hair-cutting tools is a hair-cutting razor.

4. The both hand hair cutting method as claimed in claim 1, further comprising holding a comb in one of the right and left hands.

5. The both hand hair cutting method as claimed in claim 1, wherein finish cutting comprises cutting a right side of the hair of the customer with the first hair-cutting tool held by the right hand, and cutting a left side of the hair of the customer with the second hair-cutting tool held by the left hand when the hairdresser stands in front of the customer.

6. The both hand hair cutting method as claimed in claim 1, wherein finish cutting comprises cutting a right side of the hair of the customer with the first hair-cutting tool held by the right hand, and cutting a left side of the hair of the customer with the second hair-cutting tool held by the left hand when the hairdresser stands behind the customer.

7. The both hand hair cutting method as claimed in claim 1, wherein finish cutting comprises cutting a right side of the hair of the customer with the second hair-cutting tool held by the left hand, and cutting a left side of the hair of the customer with the first hair-cutting tool held by the right hand when the hairdresser stands behind the customer.

8. The both hand hair cutting method as claimed in claim 1, wherein finish cutting comprises finish cutting the hair of the customer with the first hair-cutting tool held by the right hand and simultaneously with the second hair-cutting tool held by the left hand.

9. The both hand hair cutting method as claimed in claim 8, wherein each of the first and second hair-cutting tools is a pair of scissors.

10. The both hand hair cutting method as claimed in claim 7, wherein each of the first and second hair-cutting tools is a pair of scissors.

11. The both hand hair cutting method as claimed in claim 6, wherein each of the first and second hair-cutting tools is a pair of scissors.

12. The both hand hair cutting method as claimed in claim 5, wherein each of the first and second hair-cutting tools is a pair of scissors.

13. The both hand hair cutting method as claimed in claim 4, wherein each of the first and second hair-cutting tools is a pair of scissors.

14. The both hand hair cutting method as claimed in claim 1, wherein at least one of the first and second hair-cutting tools is a plural pair scissors.

15. The both hand hair cutting method as claimed in claim 1, wherein at least one of the first and second hair-cutting tools is a common scissors combined with a teeth shaped scissors.

16. The both hand hair cutting method as claimed in claim 1, wherein the first and second hair-cutting tools are different.

17. The both hand hair cutting method as claimed in claim 1, wherein at least one of the first and second hair-cutting tools is an electric hair cutter.

18. The both hand hair cutting method as claimed in claim 1, wherein each of the first and second hair-cutting tools is an electric hair cutter.

19. The both hand hair cutting method as claimed in claim 1, wherein at least one of the first and second hair-cutting tools is a hair-cutting razor.

20. The both hand hair cutting method as claimed in claim 1, wherein each of the first and second hair-cutting tools is a hair-cutting razor.

* * * * *